US007758319B2

(12) United States Patent
Priem et al.

(10) Patent No.: US 7,758,319 B2
(45) Date of Patent: Jul. 20, 2010

(54) INTEGRAL FILTER AND FLOAT FOR AN ELECTROMAGNETIC PUMP

(75) Inventors: Barry L. Priem, Saginaw, MI (US); Robert Alfred Stork, Saginaw, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 372 days.

(21) Appl. No.: 11/530,496

(22) Filed: Sep. 11, 2006

(65) Prior Publication Data

US 2008/0063547 A1 Mar. 13, 2008

(51) Int. Cl.
*F04B 39/00* (2006.01)

(52) U.S. Cl. ..... 417/313; 417/50

(58) Field of Classification Search ..... 417/61, 417/50, 313; 210/242.1, 416.1, 121, 258, 210/435, 451, 455, 459, 460, 461, 464, 483; 75/412; 266/227, 229, 239; 222/595
See application file for complete search history.

(56) References Cited

U.S. PATENT DOCUMENTS 1,583,377 A * 5/1926 Weleba ..... 210/242.1
2,025,545 A * 12/1935 Muff ..... 138/44
2,336,732 A * 12/1943 Howard ..... 174/46
3,751,748 A * 8/1973 Roe et al. ..... 15/230.11
3,791,757 A * 2/1974 Tarifa et al. ..... 415/89
4,124,506 A * 11/1978 Dore ..... 75/412
4,229,304 A * 10/1980 Fismer ..... 210/231
4,298,187 A * 11/1981 Dantzig et al. ..... 266/217
5,190,897 A * 3/1993 Azumi ..... 501/81
5,195,843 A * 3/1993 George et al. ..... 405/63
5,386,721 A * 2/1995 Alvizar ..... 73/114.42
5,769,326 A * 6/1998 Muchenberger et al. . 239/428.5
6,161,466 A * 12/2000 Schuller et al. ..... 91/422
D439,962 S * 4/2001 Gieseke et al. ..... D23/365
D440,293 S * 4/2001 Gieseke et al. ..... D23/365
6,913,152 B2 * 7/2005 Zuk, Jr. ..... 210/406
2005/0280179 A1 * 12/2005 Stankowski et al. ..... 264/275
2006/0162566 A1 * 7/2006 Kondo ..... 96/146

* cited by examiner

*Primary Examiner*—Devon C Kramer
*Assistant Examiner*—Dnyanesh Kasture
(74) *Attorney, Agent, or Firm*—Fraser Clemens Martin & Miller LLC; J. Douglas Miller

(57) ABSTRACT

A filtration and float apparatus and method are disclosed, wherein an integrated float frame and filter is provided, a buoyancy of the float frame and filter causing a sealing of the filtration and float apparatus with a pump.

18 Claims, 3 Drawing Sheets

INTEGRAL FILTER AND FLOAT FOR AN ELECTROMAGNETIC PUMP

FIELD OF THE INVENTION

The invention relates to a pump component and more particularly to an integrated float frame and filter apparatus and method of filtration of a molten metal flowing through an electromagnetic pump.

BACKGROUND OF THE INVENTION

Electromagnetic pumps are designed principally for use in liquid-metal-cooled reactor plants where liquid lithium, sodium, potassium, or sodium-potassium alloys are pumped. However, other metallic and nonmetallic liquids of sufficiently high electrical conductivity, such as mercury, molten aluminum, lead, and bismuth, may also be pumped in non-nuclear applications. The absence of moving parts within the electromagnetic pump eliminates the need for seals and bearings found in conventional mechanical pumps, thus militating against leaks, requiring less maintenance and repairs, and improving pump reliability.

An electromagnetic pump operates on the principle that the high electrical conductivity of the liquid metals being pumped allows a pumping force to be developed within the metals when the metals are confined in a duct or channel and subjected to a magnetic field and to an electric current. The duct or channel carrying the liquid metal is placed in the magnetic field and the electric current is passed transversely through the liquid metal so that the liquid metal is subjected to an electromagnetic force in the direction of the flow.

In a typical process involving molten aluminum, a float frame and a filter are floated on a molten aluminum bath in a furnace. An inlet of the pump is positioned adjacent the float frame and filter, and the pump and float frame are submerged in the aluminum bath. The buoyancy of the float frame holds the float frame against the pump inlet. As the molten aluminum is pumped, the filter removes impurities in the molten aluminum. Over time and through extensive use, the thermal effects of the molten aluminum on the float frame cause the float frame to crack. When the float frame breaks into several pieces, the float frame is unable to provide adequate buoyancy to maintain contact with the inlet and the filter will sink to the bottom of the molten aluminum bath in the furnace. When the filter is at the bottom of the furnace, it does not filter the molten aluminum and cannot be easily retrieved.

It would be desirable to develop a filtration and float apparatus and method, wherein the float frame and the filter remain buoyant when damage to the float frame occurs.

SUMMARY OF THE INVENTION

Concordant and congruous with the present invention, a filtration and float apparatus and method, wherein the float frame and the filter remain buoyant when damage to the float frame occurs, has surprisingly been discovered.

In one embodiment, the pump filter comprises a buoyant float frame having a central aperture formed therein, said float frame having a sealing surface formed thereon adapted for sealing engagement with an inlet of a pump; and a filter disposed in the aperture of said float frame adapted to filter impurities from a fluid flowing to the inlet of the pump.

In another embodiment, the filter for an electromagnetic pump comprises a buoyant float frame having a central aperture formed therein, said float frame having a sealing surface formed thereon adapted for sealing engagement with an inlet of the pump, wherein the buoyant float frame is formed using a molding process; and a filter disposed in the aperture of said float frame adapted to filter impurities from a fluid flowing to the inlet of the pump.

The invention also provides a method of filtering a molten metal comprising the steps of providing a buoyant float frame having a central aperture formed therein, said float frame having a sealing surface formed thereon adapted for sealing engagement with an inlet of a pump; providing a filter disposed in the aperture of said float frame adapted to filter impurities from a fluid flowing to the inlet of the pump; providing a pump; positioning the float frame adjacent an inlet of the pump; submerging the pump and float frame in a molten metal bath, wherein the float frame sealingly engages the pump due to the buoyancy of the float frame.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
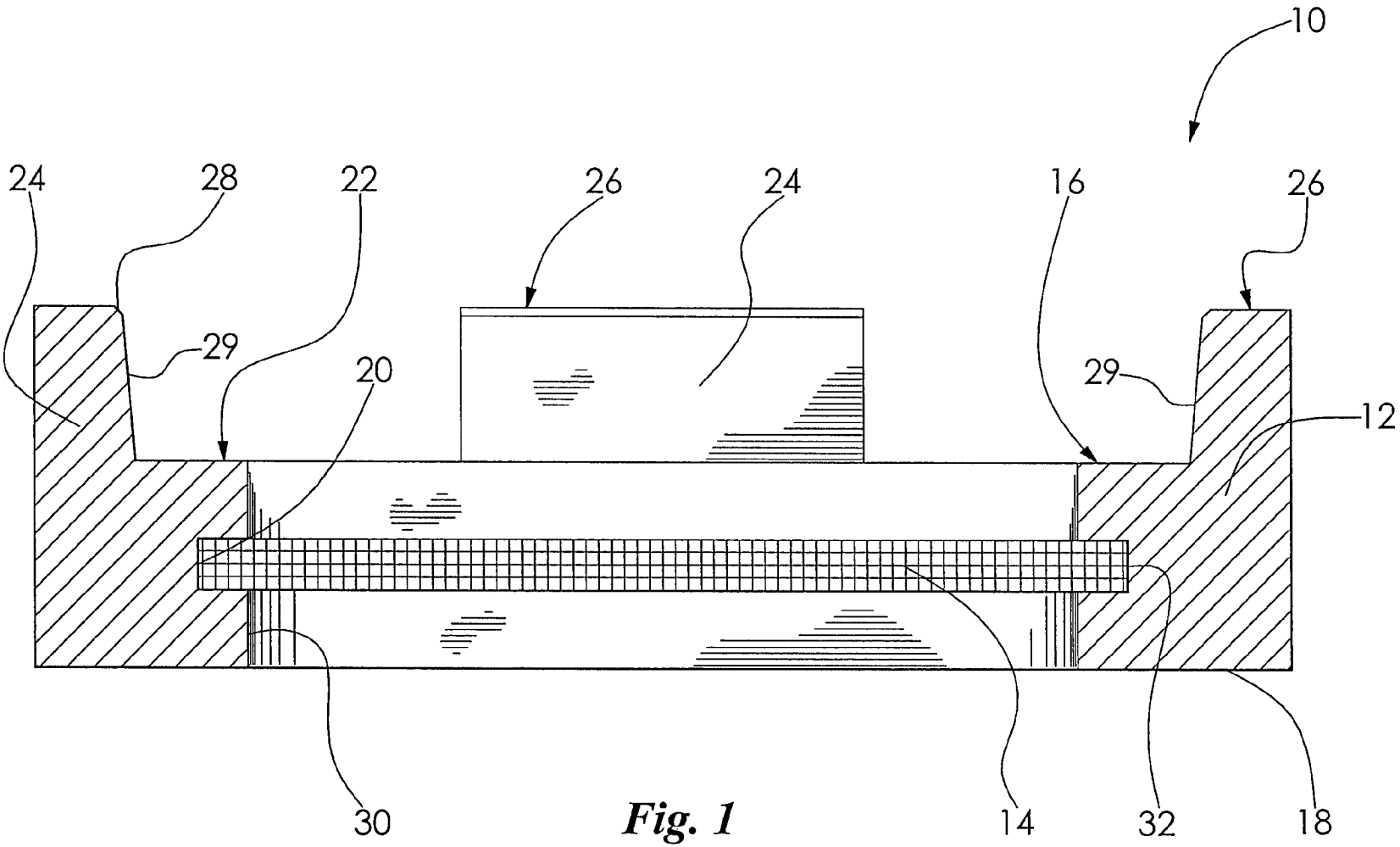
FIG. 1 is a sectional view of the float apparatus of FIG. 2 taken along line 1-1.
Figure 2:
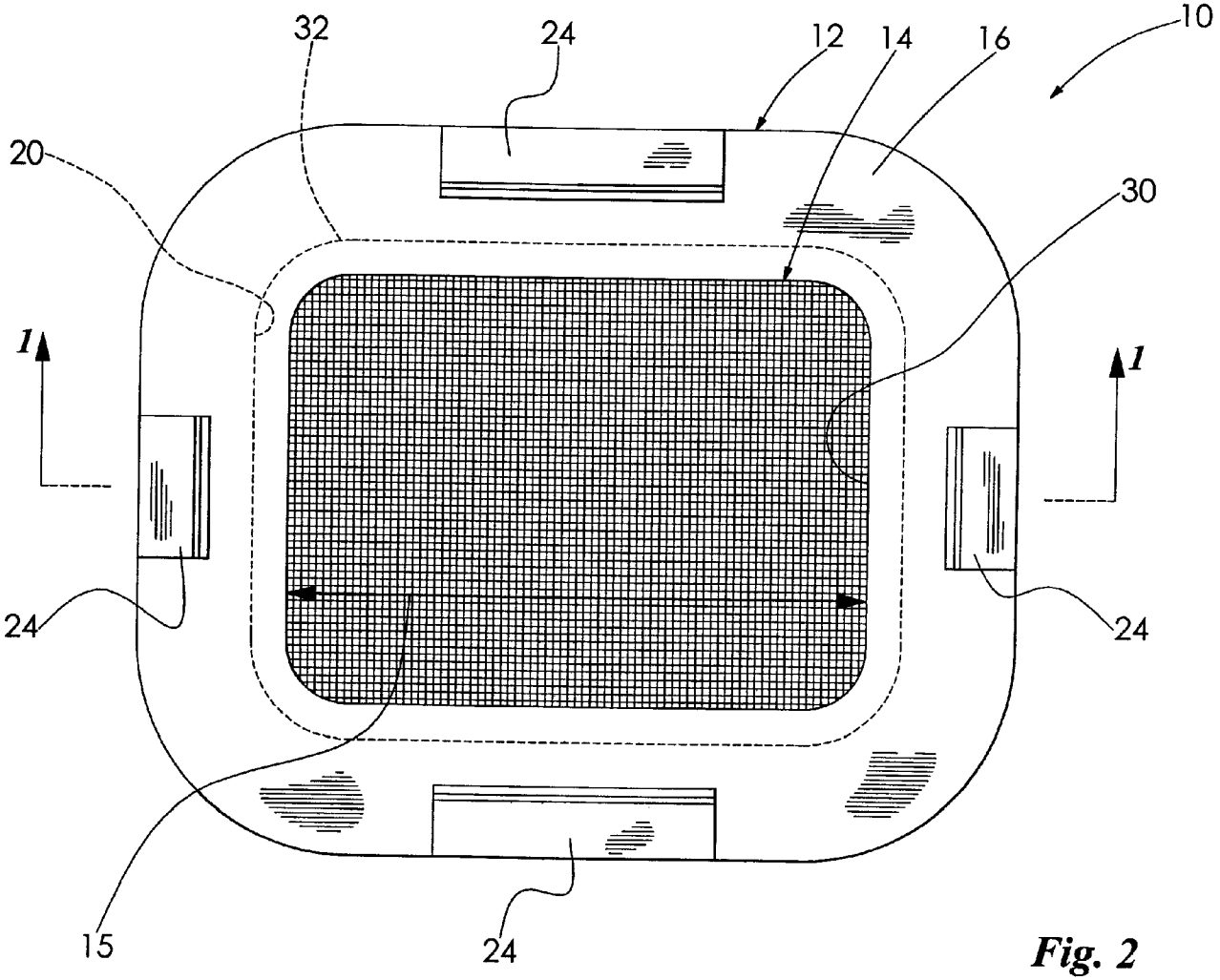
FIG. 2 is a top plan view of a float apparatus according to an embodiment of the invention.
Figure 3:
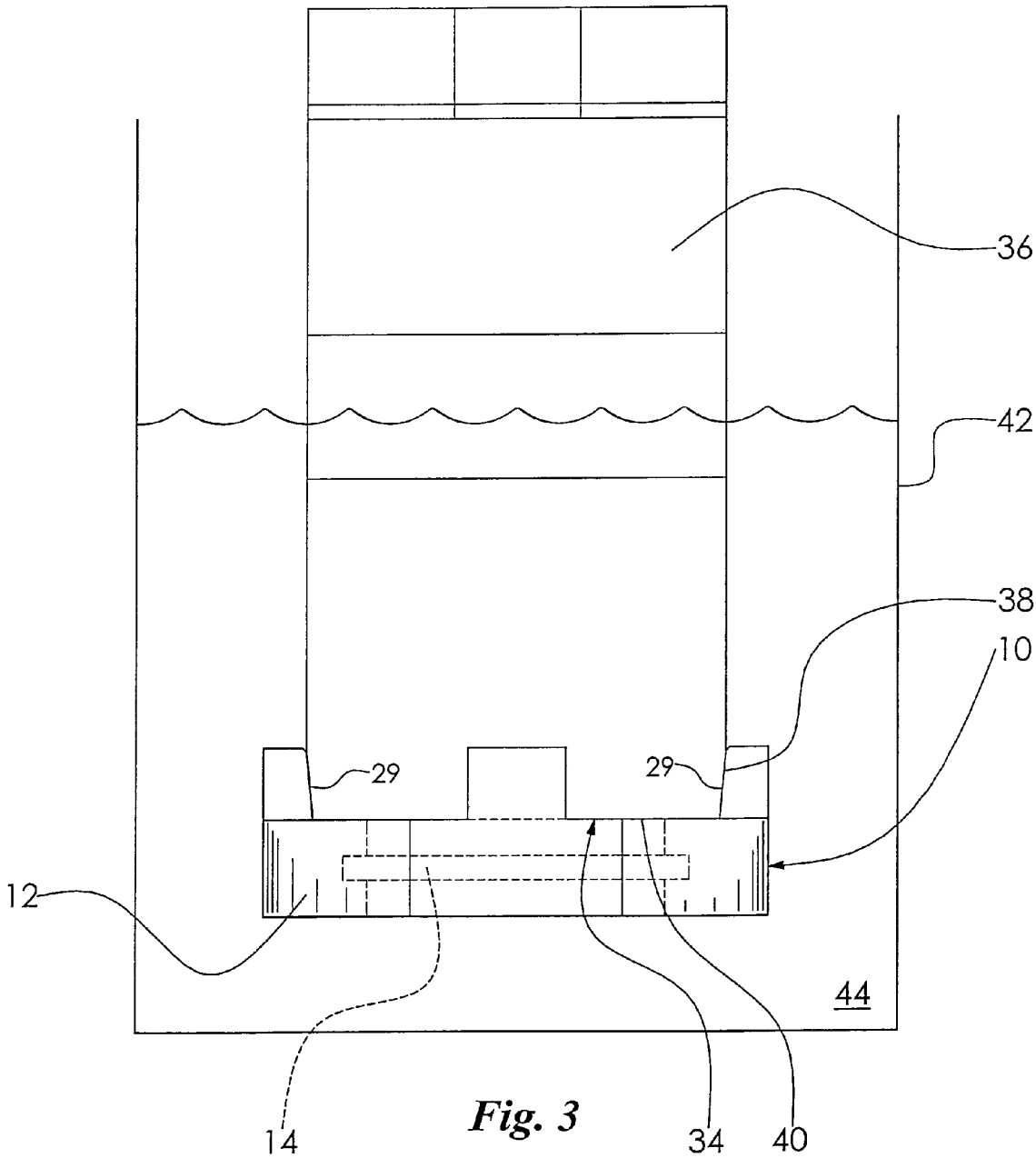
FIG. 3 is a side elevational view of the float apparatus of FIGS. 1 and 2 and an electromagnetic pump disposed in a molten metal bath.

FIG. 1 shows a float apparatus 10 according to an embodiment of the invention. The float apparatus 10 includes a float frame 12 and a filter 14. The float frame 12 has a substantially rectangular shape and a central aperture 15. It is understood that the float frame 12 may have other shapes as desired such as circular, ovoid, triangular, or other shape, for example. As illustrated in FIG. 2, the float frame 12 has a first surface 16, a second surface 18, a groove 20, a sealing surface 22, and four flanges 24 extending from the first surface 16 adjacent the sealing surface 22. The outer free edges 26 of the flanges 24 have chamfers 28 formed thereon. It is understood that the outer free edges 26 can be any shape such as substantially square or rounded, for example. As shown in FIGS. 1-3, an inner surface 29 of each of the flanges 24 is inwardly angled from the chamfer 28 formed on the outer free edge 26 thereof to the sealing surface 22 of the float frame 12. The groove 20 is formed intermediate the first surface 16 and the second surface 18 on an inner surface 30 of the float frame 12. The groove 20 is adapted to receive an outer peripheral edge 32 of the filter 14. The sealing surface 22 surrounds the aperture 15. In the embodiment shown, the float frame 12 is formed from a silica based material having a chemical composition of: 68.4% $SiO_2$, 23.1% $Al_2O_3$, 4.5% CaO, 2.9% ZnO, 1.1% other material. However, it is understood that other silica based materials may be used as well as other conventional materials such as refractory ceramics, and other cement-like materials, for example.

The outer peripheral edge 32 of the filter 14 is disposed in the groove 20 of the float frame 12. It is understood that the filter 14 can be joined to the float frame 12 by any conventional means as desired. The shape of the filter 14 conforms generally to the shape of the float frame 12, although it is understood that different shapes can be used. In the embodiment shown, the filter 14 is a fused silicone carbide (SiC) particle filter. However, it is understood that any conventional filters can be used, as desired.

In the embodiment shown, the filter 14 and the float frame 12 are formed by disposing the filter 14 in a mold (not shown) during a cast molding operation of the float frame 12. The outer peripheral edge 32 of the filter 14 is disposed in the portion of the mold that forms the groove 20 of the float frame 12. The material forming the float frame 12 is disposed into the mold. When the material forming the float frame 12 reaches a desired hardened state, the outer peripheral edge 32 of the filter 14 is held in position in the groove 20 of the float frame 12. It is understood that the material forming the float frame 12 may adhere to the outer peripheral edge 32 of the filter 14. It is further understood that the filter 14 may be disposed in the groove 20 and coupled to the float frame 12 with a conventional fastener means (not shown) such as an adhesive or bolt, for example. It also understood that other mounting structures such as a lip or mounting brackets can be used, as desired.

In use, as shown in FIG. 3, the float apparatus 10 is positioned adjacent an inlet 34 of a pump 36. The float apparatus 10 positioned such that the flanges 24 of the float apparatus 10 abut an outer wall 38 of the inlet 34 and the sealing surface 22 abuts an outer free edge 40 of the inlet 34. The chamfers 28 and the inner surfaces 29 of the flanges 24 are adapted to guide the pump 36 into sealing engagement with the float apparatus 10. In the embodiment shown, the pump 36 is an electromagnetic pump. It is understood that the pump 36 may be any conventional pump, as desired. When the float apparatus 10 is in a sealing position, the pump 36 and float apparatus 10 are placed in a fluid bath 42 in a furnace (not shown). The second surface 18 of the float apparatus 10 is the first portion of the float apparatus 10 to contact the fluid bath 42. The pump 36 and float apparatus 10 are then submerged in the fluid bath 42. The buoyancy of the material used to form the float frame 12 of the float apparatus 10 causes the sealing surface 22 of the float apparatus 10 to sealingly engage the inlet 34 of the pump 36 and militate against leakage. The combination of the buoyant force generated by the float being submerged in a fluid 44 in the fluid bath 42 against the float frame 12 and the flanges 24 abutting the outer wall 38 of the inlet 34 hold the float apparatus 10 against the inlet 34.

The pump 36 is operated, and the fluid 44 in the fluid bath 42 is caused to flow through the filter 14 of the float apparatus 10. Particulate and other impurities are removed from the fluid 44 as the fluid 44 flows through the filter 14. The fluid 44 then flows through the pump 36 to a conduit (not shown) to be utilized in a downstream operation. In the embodiment shown the fluid 44 in the fluid bath 42 is molten aluminum. It is understood that the fluid 44 may be mercury, lead, bismuth, or other molten material, as desired. It is further understood that the fluid bath 42 may be liquid salts used for nuclear and applications, as desired.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A pump filter comprising:

a buoyant float frame having a central aperture formed therein, said float frame having a surface including a sealing surface formed thereon adapted for sealing engagement with an inlet of a pump;

a filter disposed in the central aperture of said float frame adapted to filter impurities from a fluid flowing to the inlet of the pump; and a plurality of flanges extending laterally outwardly from an outer peripheral edge of the surface of said float frame, said flanges including a chamfer formed on an outer free edge thereof and an inner surface angled inwardly from the chamfer toward the central aperture formed in said float frame, wherein the chamfer and the inner surface of each of said flanges guide said float frame into sealing engagement with the inlet of the pump.

2. The pump filter of claim 1, wherein said float frame includes a groove formed therein adapted to receive a peripheral edge of said filter.

3. The pump filter of claim 1, wherein said float frame is formed using a molding process.

4. The pump filter of claim 1, wherein said filter is integrally formed with said float frame.

5. The pump filter of claim 1, wherein the buoyancy of said float frame causes the sealing engagement between the pump and said float frame.

6. The pump filter of claim 1, wherein the pump is an electromagnetic pump.

7. The pump filter of claim 6, wherein the molten metal is aluminum.

8. The pump filter of claim 1, wherein the fluid is a molten metal.

9. The pump filter of claim 1, wherein a shape of the pump filter is chosen from a group consisting of substantially rectangular, substantially circular, and substantially triangular.

10. The pump of claim 1, wherein the filter is a fused silicone carbide particle filter.

11. The pump of claim 1, wherein the float frame is produced from a silica based material with a composition of: 68.4% $SiO_2$, 23.1% $Al_2O_3$, 4.5% CaO, 2.9% ZnO, 1.1% other material.

12. A filter for an electromagnetic pump comprising:

a buoyant float frame having a central aperture formed therein, said float frame having a surface including a sealing surface formed thereon adapted for sealing engagement with an inlet of the pump, wherein the buoyant float frame is formed using a molding process;

a filter disposed in the central aperture of said float frame adapted to filter impurities from a fluid flowing to the inlet of the pump; and a plurality of flanges extending laterally outwardly from an outer peripheral edge of the surface of said float frame, flanges including a chamfer formed on an outer free edge thereof and an inner surface angled inwardly from the chamfer toward the central aperture formed in said float frame, wherein the chamfer and the inner surface of each of said flanges guide said float frame into sealing engagement with the inlet of the pump.

13. The pump filter of claim 12, wherein the pump is an electromagnetic pump.

14. The pump filter of claim 12, wherein the fluid is a molten metal.

15. The pump filter of claim 14, wherein the molten metal is aluminum.

16. The pump filter of claim 12, wherein said filter is integrally formed with said float frame by the molding process of said float frame.

17. The pump filter of claim 12, wherein said float frame includes a groove formed therein adapted to receive a peripheral edge of said filter.

18. The pump filter of claim 12, wherein the buoyancy of said float frame causes the sealing engagement between the pump and said float frame.

* * * * *